US011358025B2

(12) United States Patent
Corbalis

(10) Patent No.: US 11,358,025 B2
(45) Date of Patent: Jun. 14, 2022

(54) TORQUE OVERDRIVE STAIR CLIMBER

(71) Applicant: Core Health and Fitness, LLC., Vancouver, WA (US)

(72) Inventor: Kevin Corbalis, Tustin, CA (US)

(73) Assignee: Core Health and Fitness, LLC, Vancouver, WA (US)

( * ) Notice: Subject to any disclaimer, the term of this patent is extended or adjusted under 35 U.S.C. 154(b) by 127 days.

(21) Appl. No.: 16/819,010

(22) Filed: Mar. 13, 2020

(65) Prior Publication Data

US 2020/0316431 A1 Oct. 8, 2020

Related U.S. Application Data

(60) Provisional application No. 62/818,083, filed on Mar. 13, 2019.

(51) Int. Cl.

| | |
|---|---|
| ***A63B 22/04*** | (2006.01) |
| ***A63B 21/005*** | (2006.01) |
| ***A63B 24/00*** | (2006.01) |
| ***A63B 21/00*** | (2006.01) |
| *A63B 71/06* | (2006.01) |

(52) U.S. Cl.

CPC ..... *A63B 22/04* (2013.01); *A63B 21/005* (2013.01); *A63B 21/151* (2013.01); *A63B 21/4033* (2015.10); *A63B 24/0087* (2013.01); *A63B 2024/0093* (2013.01); *A63B 2071/0675* (2013.01); *A63B 2220/50* (2013.01); *A63B 2230/015* (2013.01)

(58) Field of Classification Search

None

See application file for complete search history.

(56) References Cited

U.S. PATENT DOCUMENTS 5,556,352 A * 9/1996 Chang ..... A63B 22/04 482/51

5,707,319 A * 1/1998 Riley ..... A63B 22/001 482/54

(Continued)

OTHER PUBLICATIONS

PCT/US2020/022825, "Notification of transmittal of the international search report and the written opinion of the International searching authority, or the declaration", PCT, dated Jun. 15, 2020, pp. 1-15.

*Primary Examiner* — Sundhara M Ganesan
*Assistant Examiner* — Shila Jalalzadeh Abyaneh
(74) *Attorney, Agent, or Firm* — Foley & Lardner LLP

(57) ABSTRACT

Disclosed herein is a stair climber that includes a frame having a base, an upper axle and a lower axle, and steps revolvably coupled to the upper axle and the lower axle. The stair climber also includes an electric brake mechanism operating in generative mode and coupled with the steps and configured to provide a variable resistive force. Also included is a controller that receives an indication of a selected exercise mode from a user that includes a first speed, a second speed, and a difficulty level. The controller also balances a load, in a learning mode, on the steps based a user's weight at the first speed, and controls, in response to the user applying an additional load to the steps via a rail system, the electric brake mechanism to apply the difficulty level of the selected exercise mode and prevent the steps from exceeding the second speed.

19 Claims, 17 Drawing Sheets

(56) References Cited

U.S. PATENT DOCUMENTS

| | | | | |
|---|---|---|---|---|
| 8,702,571 | B2 * | 4/2014 | Fenster | A63B 21/0051 482/52 |
| 8,974,353 | B2 | 3/2015 | Fenster et al. | |
| 10,105,568 | B2 | 10/2018 | Golen, Jr. et al. | |
| 2012/0115685 | A1 | 5/2012 | Bedell et al. | |
| 2015/0141201 | A1 * | 5/2015 | Orgal | A63B 23/0458 482/8 |
| 2015/0165263 | A1 * | 6/2015 | Golen, Jr. | A63B 21/0058 482/7 |
| 2015/0190670 | A1 * | 7/2015 | Strommen | A63B 22/04 482/52 |
| 2018/0243606 | A1 * | 8/2018 | Burck | A63B 21/157 |
| 2018/0369634 | A1 * | 12/2018 | Kueker | A63B 22/0046 |
| 2020/0376329 | A1 * | 12/2020 | Liao | A63B 21/0058 |

* cited by examiner

TORQUE OVERDRIVE STAIR CLIMBER

CROSS-REFERENCES TO RELATED APPLICATIONS

This application claims the benefit of U.S. Provisional Patent Application No. 62/818,083 entitled "TORQUE OVERDRIVE STAIR CLIMBER" and filed on Mar. 13, 2019 for Kevin Corbalis, which is incorporated herein by reference.

FIELD

This disclosure relates to exercise equipment and more particularly relates to exercise equipment that simulates stair climbing.

BACKGROUND

Stair climbing is known as an effective type of exercise, and for this reason, exercise machines that simulate stair climbing are popular for both home and commercial gym use. Many different types of systems have been developed to simulate stair climbing, including four-bar linkage pedal systems, oscillating pedals, reciprocating pedals, and treadmill-style staircases. Controlling the speed of the moving steps is always a concern, otherwise the steps will continue to accelerate until it is no longer safe for the user. Additionally, current exercise machines that simulate stair climbing do not allow for the user to incorporate sled-push or farmer-carry style exercises with a stair-climbing exercise machine.

SUMMARY

The subject matter of the present application provides example exercise machines that overcome the above-discussed shortcomings of prior art techniques. The subject matter of the present application has been developed in response to the present state of the art, and in particular, in response to shortcomings of stair climbers.

Disclosed herein is a stair climber that includes a frame having a base, an upper axle and a lower axle, each rotatably coupled to the frame, and a plurality of steps, that is endless, revolvably coupled to the upper axle and the lower axle and configured to move cyclically. The stair climber also includes an electric brake mechanism operating in generative mode mechanically coupled with the plurality of steps and configured to provide a variable resistive force, and a controller operably coupled to the electric brake mechanism and configured to: receive an indication of a selected exercise mode from a user, the selected exercise mode comprising a first speed of the plurality of steps, a second speed of the plurality of steps, and a difficulty level; balance a load, in a learning mode, on the plurality of steps based on a user's weight at the first speed; and control, in response to the user applying an additional load to the plurality of steps via a rail system extending upward from the frame, the electric brake mechanism to apply the difficulty level of the selected exercise mode and prevent the plurality of steps from exceeding the second speed. The preceding subject matter of this paragraph characterizes example 1 of the present disclosure.

In certain examples, the controller is further configured to, in response to the user removing the additional load, control the electric brake mechanism to maintain the first speed of the plurality of steps. The preceding subject matter of this paragraph characterizes example 2 of the present disclosure, wherein example 2 also includes the subject matter according to example 1, above.

The stair climber also includes, in certain embodiments, a pair of chains revolvably disposed around the upper axle and the lower axle, where each of the pair of chains is coupled to the endless plurality of steps and engages a step gear. The preceding subject matter of this paragraph characterizes example 3 of the present disclosure, wherein example 3 also includes the subject matter according to any of examples 1-2, above.

In certain examples, the stair climber also includes a braking solenoid coupled to the electric brake mechanism and configured to prevent rotational movement of an output shaft of the electric brake mechanism when in a power-off mode. The preceding subject matter of this paragraph characterizes example 4 of the present disclosure, wherein example 4 also includes the subject matter according to any of examples 1-3, above.

The electric brake mechanism, in certain examples, is configured to apply a variable amount of rotational resistance to the output shaft of the electric brake mechanism, and where the variable amount of rotational resistance is based on a load electrically coupled to the electric brake mechanism. The preceding subject matter of this paragraph characterizes example 5 of the present disclosure, wherein example 5 also includes the subject matter according to example 4, above.

In certain examples, the controller is further configured to, in response to a determination that the user has started the selected exercise mode, energize a braking solenoid coupled with the output shaft of the electric brake mechanism to allow rotational movement of the output shaft. The preceding subject matter of this paragraph characterizes example 6 of the present disclosure, wherein example 6 also includes the subject matter of example 5, above.

The controller, in certain examples, is further configured to, in response to a determination that the user has ended the selected exercise mode, one of increase or decrease the resistive force to reach a shutdown speed of the plurality of steps. The preceding subject matter of this paragraph characterizes example 7 of the present disclosure, wherein example 7 also includes the subject matter according to any of examples 5-6, above.

In certain examples, the controller is further configured to, subsequent to the plurality of steps reaching the shutdown speed, de-energize the braking solenoid and prevent movement of the plurality of steps by stopping rotational movement of the output shaft of the electric brake mechanism. The preceding subject matter of this paragraph characterizes example 8 of the present disclosure, wherein example 8 also includes the subject matter according to any of examples 5-7, above.

The load, in certain examples, comprises a variable resistor electrically coupled to the electric motor and configured to dissipate electricity generated by the electric motor. The preceding subject matter of this paragraph characterizes example 9 of the present disclosure, wherein example 9 also includes the subject matter according to any of examples 5-8 above.

In certain examples, the stair climber also includes a speed sensor configured to determine a rotational speed of the plurality of steps. The preceding subject matter of this paragraph characterizes example 10 of the present disclosure, wherein example 10 also includes the subject matter according to any of examples 1-9, above.

The controller, in certain examples, is configured to communicate with the speed sensor. The preceding subject matter of this paragraph characterizes example 11 of the present disclosure, wherein example 11 also includes the subject matter according to example 10, above.

In certain examples, the controller is further configured to balance the load by determining a weight of the user based on an amount of resistive force required to maintain the first speed of the plurality of steps. The preceding subject matter of this paragraph characterizes example 12 of the present disclosure, wherein example 12 also includes the subject matter according to any of examples 1-11, above.

Also disclosed is a controller having at least one computing device that is configured for performing actions, where the at least one computing device includes a processor and a local memory. The actions include: receiving, at the controller operably coupled to a stair climber device having a frame and a plurality of steps that is endless, an indication of a selected exercise mode from a user, the selected exercise mode comprising a first speed of the plurality of steps, a second speed of the plurality of steps, and a difficulty level; balancing a load, in a learning mode, on the plurality of steps based a user's weight at the first speed; and controlling, in response to the user applying an additional load to the plurality of steps via a rail system extending upward from the frame, the electric brake mechanism to apply the difficulty level of the selected exercise mode and prevent the plurality of steps from exceeding the second speed. The preceding subject matter of this paragraph characterizes example 13 of the present disclosure.

In certain examples, the actions also include controlling, in response to the user removing the additional load, the electric brake mechanism to maintain the first speed of the plurality of steps. The preceding subject matter of this paragraph characterizes example 14 of the present disclosure, wherein example 14 also includes the subject matter according to example 13, above.

The actions also include, in certain examples, controlling a braking solenoid coupled to the electric brake mechanism to prevent rotational movement of an output shaft of the electric brake mechanism when in a power-off mode. The preceding subject matter of this paragraph characterizes example 15 of the present disclosure, wherein example 15 also includes the subject matter according to any of the examples 13-14, above.

In certain examples, the actions also include, in response to a determination that the user has started the selected exercise mode, energizing the braking solenoid coupled with an output shaft of the electric brake mechanism to allow rotational movement of the output shaft. The preceding subject matter of this paragraph characterizes example 16 of the present disclosure, wherein example 16 also includes the subject matter according to example 15, above.

The actions also include, in certain examples, determining a rotational speed of the plurality of steps and increasing the resistive force in response to a determination that the rotational speed of the plurality of steps is greater than the second speed. The preceding subject matter of this paragraph characterizes example 17 of the present disclosure, wherein example 17 also includes the subject matter according to any of examples 13-16, above.

A method of controlling a speed of a plurality of steps in an exercise machine is also included. The method includes, in certain examples, receiving, at a controller operably coupled to the exercise machine which has a frame and the plurality of steps that is endless, an indication of a selected exercise mode from a user, the selected exercise mode comprising a first speed of the plurality of steps, a second speed of the plurality of steps, and a difficulty level; balancing a load, in a learning mode, on the plurality of steps based on a user's weight at the first speed; and controlling, in response to the user applying an additional load to the plurality of steps via a rail system extending upward from the frame, the electric brake mechanism to apply the difficulty level of the selected exercise mode and prevent the plurality of steps from exceeding the second speed. The preceding subject matter of this paragraph characterizes example 18 of the present disclosure.

The method also includes, in certain examples, controlling, in response to the user removing the additional load, the electric brake mechanism to maintain the first speed of the plurality of steps. The preceding subject matter of this paragraph characterizes example 19 of the present disclosure, wherein example 19 also includes the subject matter according to example 18, above.

In certain examples, the method also includes controlling a braking solenoid coupled to the electric brake mechanism to prevent rotational movement of an output shaft of the electric brake mechanism when in a power-off mode. The preceding subject matter of this paragraph characterizes example 20 of the present disclosure, wherein example 20 also includes the subject matter according to any of examples 18-19, above.

The described features, structures, advantages, and/or characteristics of the subject matter of the present disclosure may be combined in any suitable manner in one or more examples, including embodiments and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example, embodiment, or implementation. In other instances, additional features and advantages may be recognized in certain examples, embodiments, and/or implementations that may not be present in all examples, embodiments, or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
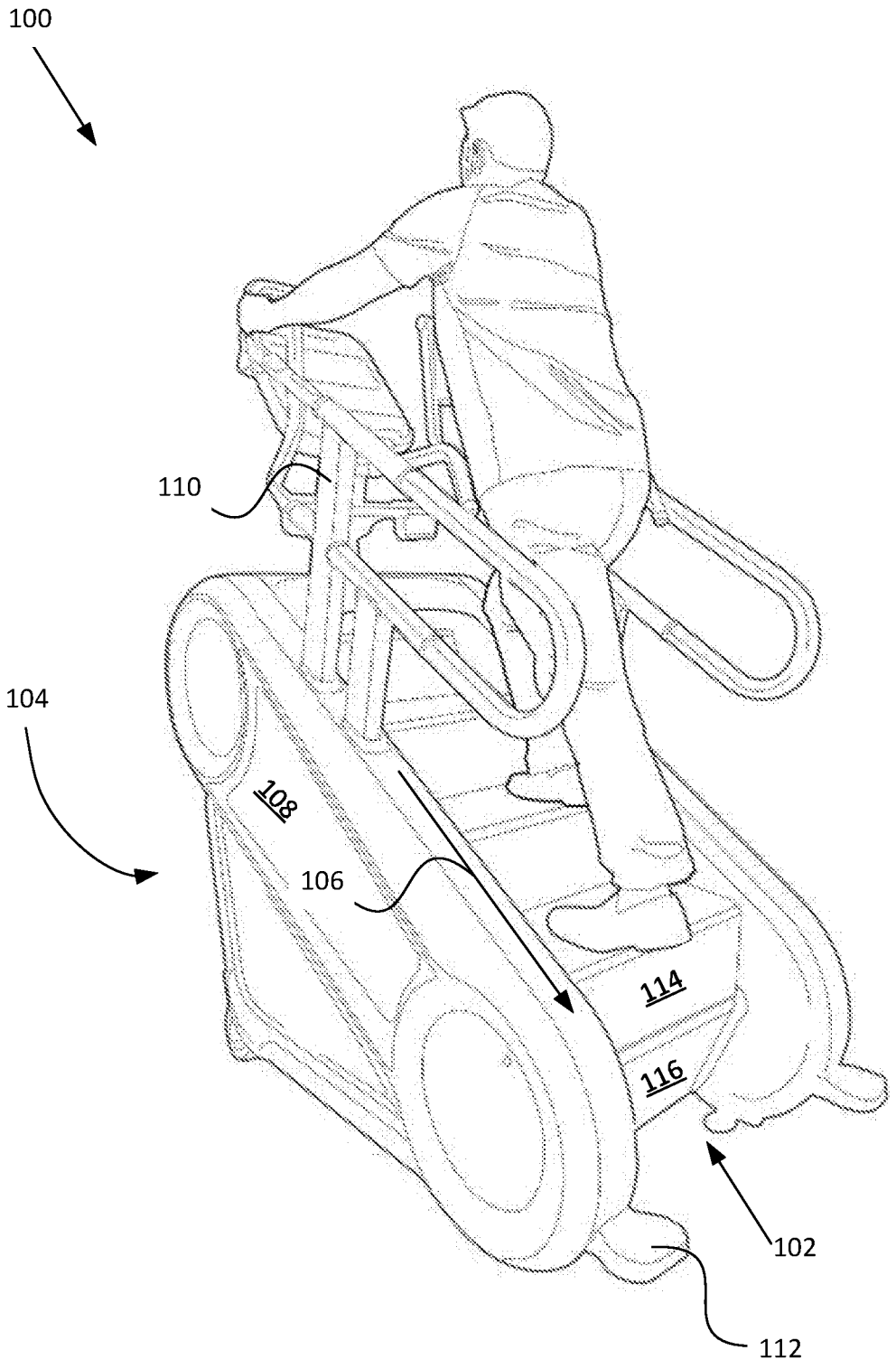
FIG. 1 is a perspective view diagram illustrating one embodiment of a stair-climber exercise machine ("machine") in accordance with examples of the present disclosure.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The present invention may be a system, a method, and/or an apparatus including a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory ("RAM"), a read-only memory ("ROM"), an erasable programmable read-only memory ("EPROM" or Flash memory), a static random access memory ("SRAM"), a portable compact disc read-only memory ("CD-ROM"), a digital versatile disk ("DVD"), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of program instructions may, for instance, comprise one or more physical or logical blocks of computer instructions which may, for instance, be organized as an object, procedure, or function. Nevertheless, the executables of an identified module need not be physically located together but may comprise disparate instructions stored in different locations which, when joined logically together, comprise the module and achieve the stated purpose for the module.

Furthermore, the described features, structures, or characteristics of the embodiments may be combined in any suitable manner. In the following description, numerous specific details are provided to give a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

The description of elements in each figure may refer to elements of proceeding figures. Like numbers refer to like elements in all figures, including alternate embodiments of like elements. Similar elements may be referred to with a number and a letter, such as "102*a*" and "102*b*", when identified individually, and when referred to jointly by the number only (i.e., "102" without that "a" or "b").

FIG. 1 is a perspective view diagram illustrating one embodiment of a stair-climber exercise machine (hereinafter "machine") 100 in accordance with embodiments of the present disclosure. The machine 100 is configured with a plurality of steps 102 supported by a stationary frame 104. The steps 102 are formed as part of an endless conveyor system that cyclically moves downward in a direction indicated by arrow 106. The steps 102 are coupled to chains that cycle around toothed sprockets, as will be described in greater detail below.

A removable cladding 108 may be coupled to the frame 104 and configured to house the internal components of the machine 100. The cladding 108 may be formed of a lightweight material, examples of which may include, but are not limited to, polymer materials. Extending upward from the frame 104 is a rail system 110 formed of a rigid and durable material. The rail system 110, as will be described in greater detail below, is configured with multiple hand positions to enable different types of exercises including, but not limited to, a "sled push" exercise and a "farmer carry" exercise. The rail system 110 may be formed with multiple vertically extending supports that extend generally upward from the frame 104. The vertically extending supports are coupled to an upper framework that serves multiple purposes including forming a barrier to prevent the user from falling to one side or the other of the machine 100, and forming the different hand positions.

The frame 104 may also be formed with multiple access steps 112 that are in an elevated position relative to a floor upon which the frame 104 rests. The frame 104 includes a base (not shown here) that engages the floor and supports the rest of the machine 10.

Each of the steps 102 is formed from a riser portion 114 and a platform portion 116. The risers 114 and platforms 116 are coupled to each other by a hinge mechanism so that each step is pivotally connected to the adjacent step. Accordingly, the plurality of steps 102 are formed by alternating risers 114 and platforms 116. The risers 114 and platforms 116 may have dimensions that are similar to the steps of a building or house (i.e., the riser 114 has a height of about 9 inches, and the platform 116 has a depth of about 10 inches).

Figure 2:
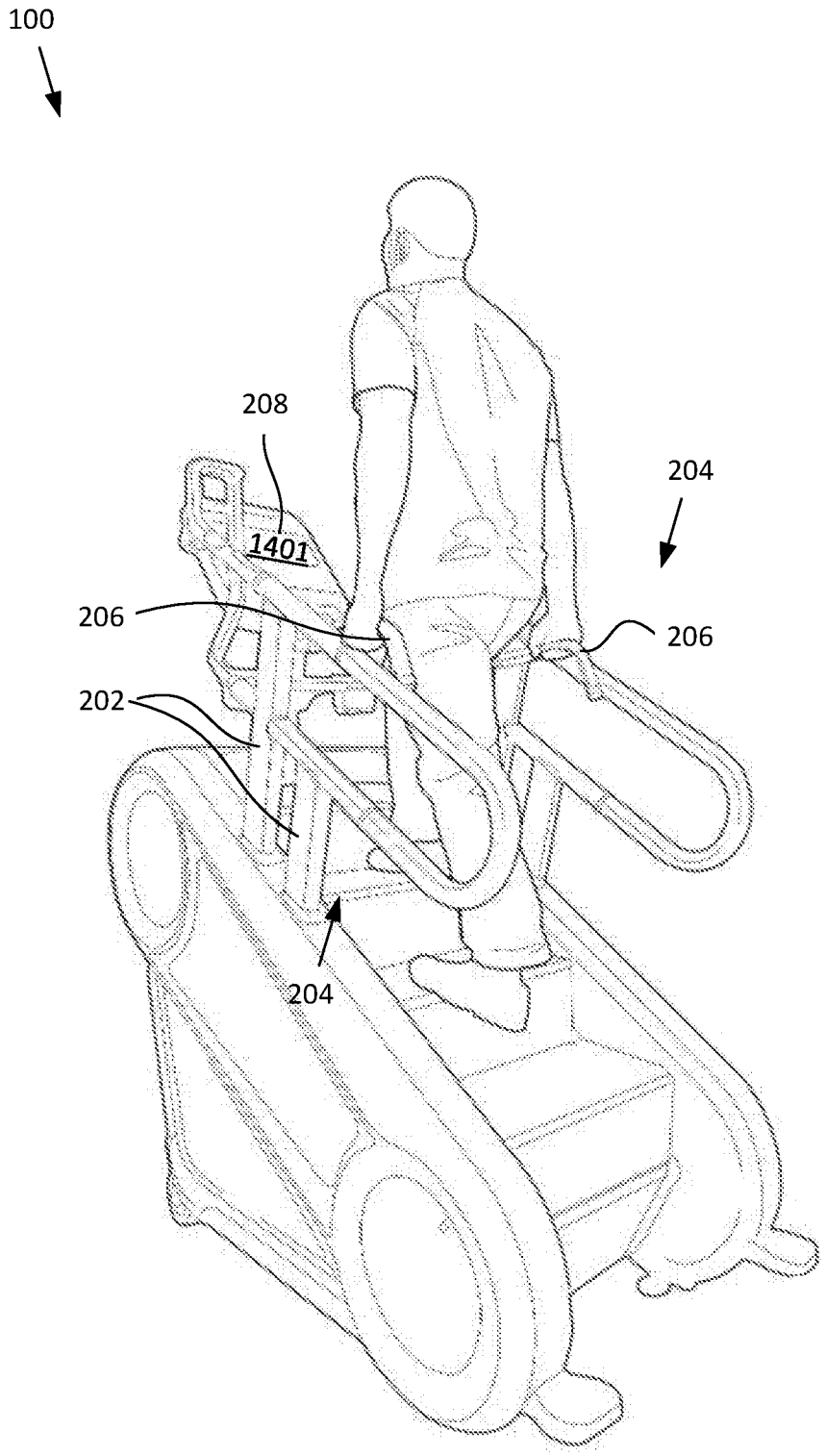
FIGS. 2 and 3 are perspective view diagrams illustrating another embodiment of the machine in accordance with examples of the present disclosure.
Figure 3:
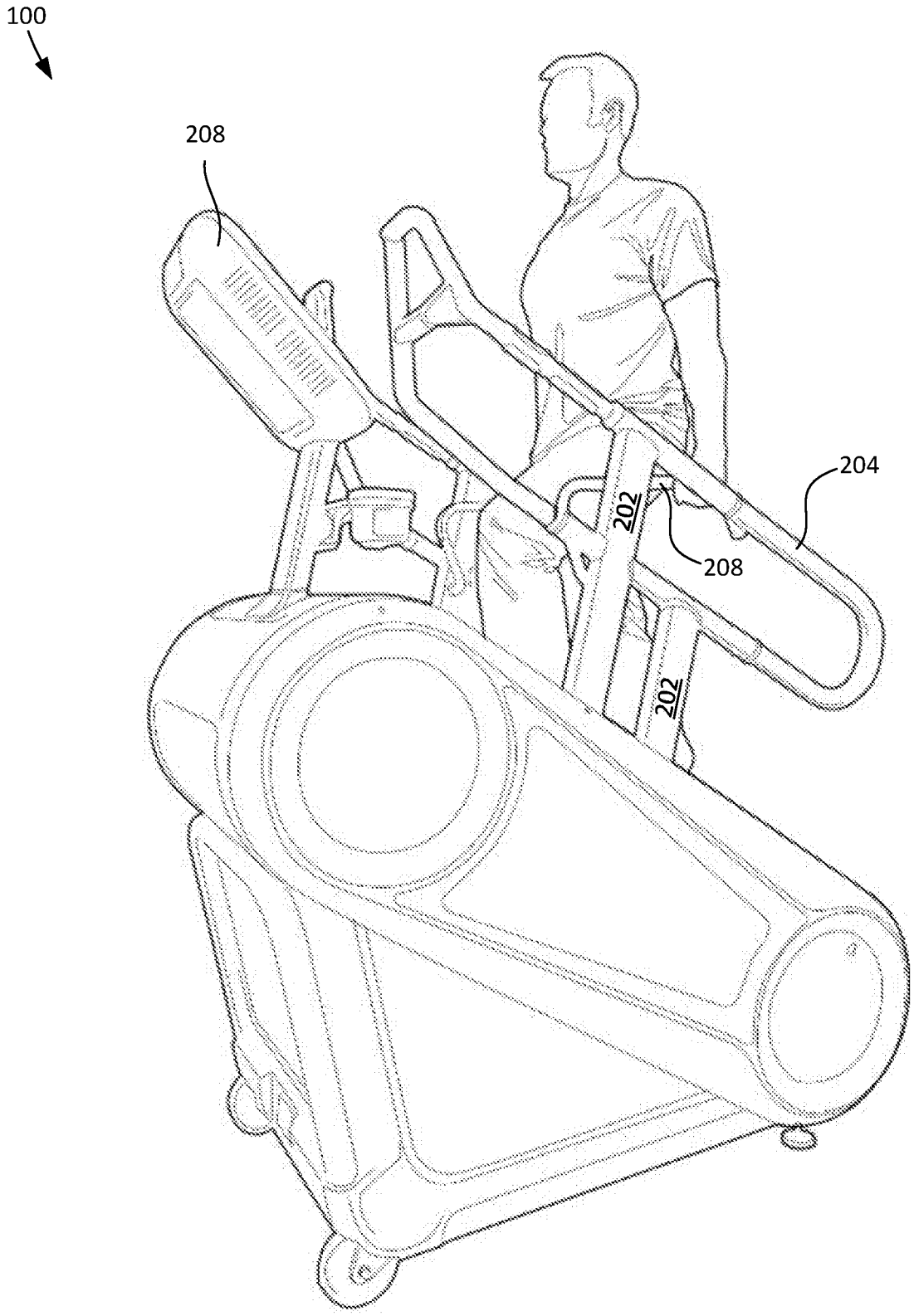

FIGS. 2 and 3 are perspective view diagrams illustrating another embodiment of the machine 100 in accordance with embodiments of the present disclosure. The depicted embodiment illustrates a user performing a "farmer carry" exercise. The rail system 110 includes a plurality of tubes that extend from uprights 202 to form left and right-side portions 204. The side portions 204 form a barrier on either side of the user so that the user is prevented from falling off the side of the machine 100. Coupled to one of the uprights 202 and positioned on the inside of the side portions 204, is a farmer-carry handle 206. The farmer-carry handle 206 extends rearward (away from a control panel that houses a controller 1401) from the upright 202 in a generally horizontal direction.

The farmer-carry handle 206 may have a downward bend to form a hand-hold position. In certain embodiments, the machine 100 is configured with a pair of farmer-carry handles 206. The farmer-carry handles 206 allow the user to simulate a farmer-carry exercise safely. Previously, there was no way to combine a stair-stepping exercise with a farmer carry safely. As will be discussed below, the machine 100 is configured to prevent the stairs from moving at a speed greater than a predetermined maximum speed. Without this ability, a user performing a farmer carry would increase the stair speed to a speed that is unsafe and unusable as a stair stepping exercise.

Figure 4:
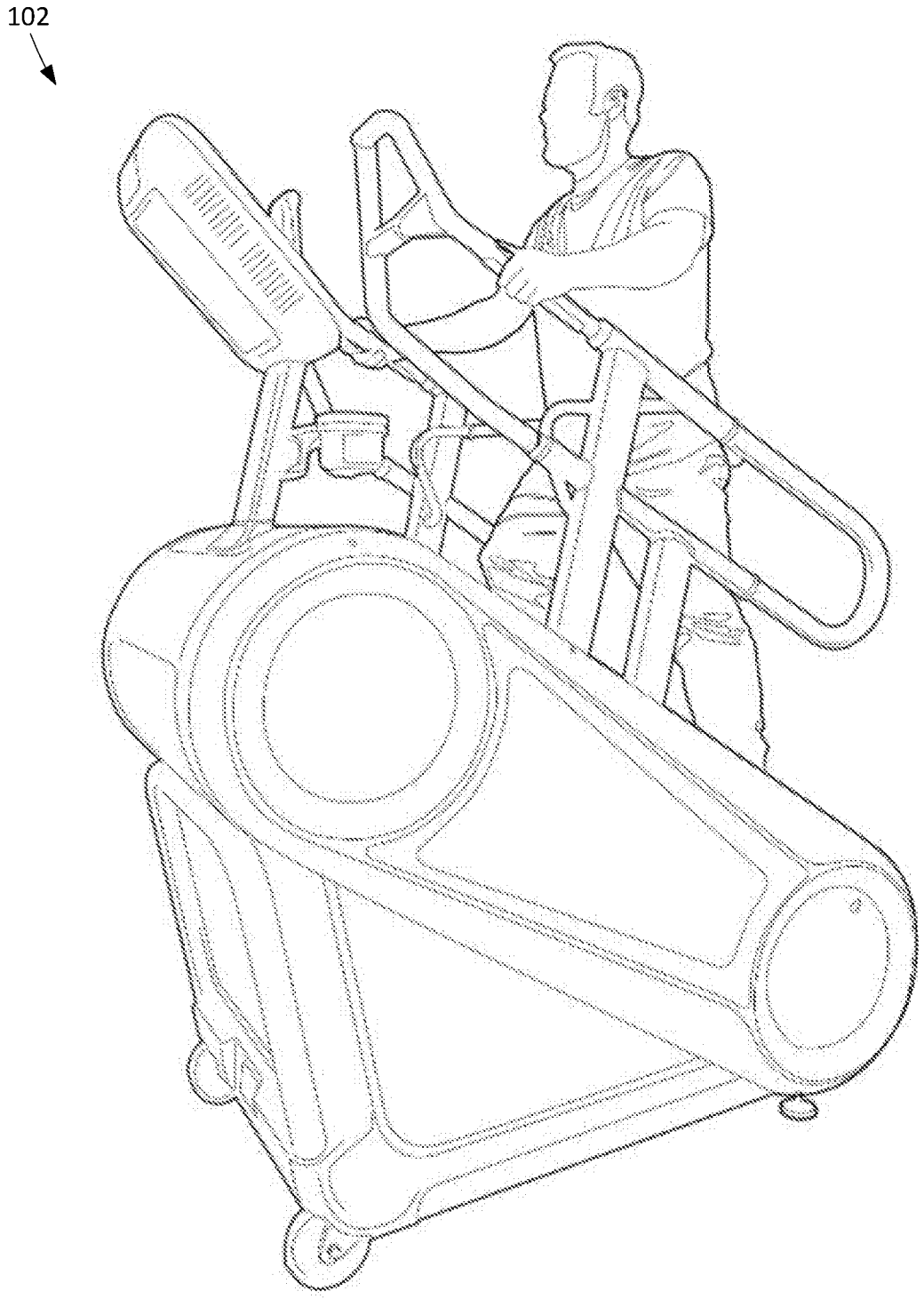
FIG. 4 is a perspective view diagram illustrating another embodiment of a user-exercise position in accordance with examples of the present disclosure.

FIG. 4 is a perspective view diagram illustrating another embodiment of a user-exercise position in accordance with embodiments of the present disclosure. The user may grasp the rails in a more traditional exercise position as depicted. The steps 102 of the machine 100, in one embodiment, are not powered. Gravity and the weight of the user cause the downward and away (with reference to the top/front of the machine, i.e., where the controller 1401 is positioned) movement of the steps. Typically, the steps will move at a speed that is appropriate for the exercise. Previously, if a user attempted to "load" (i.e., increase the difficulty) the steps with extra force (e.g., via the farmer carry or sled push) then the steps would accelerate to an unsafe speed. As mentioned above, embodiments of the present disclosure beneficially overcome this by managing a resistive force to maintain a maximum speed of the steps.

Figure 5:
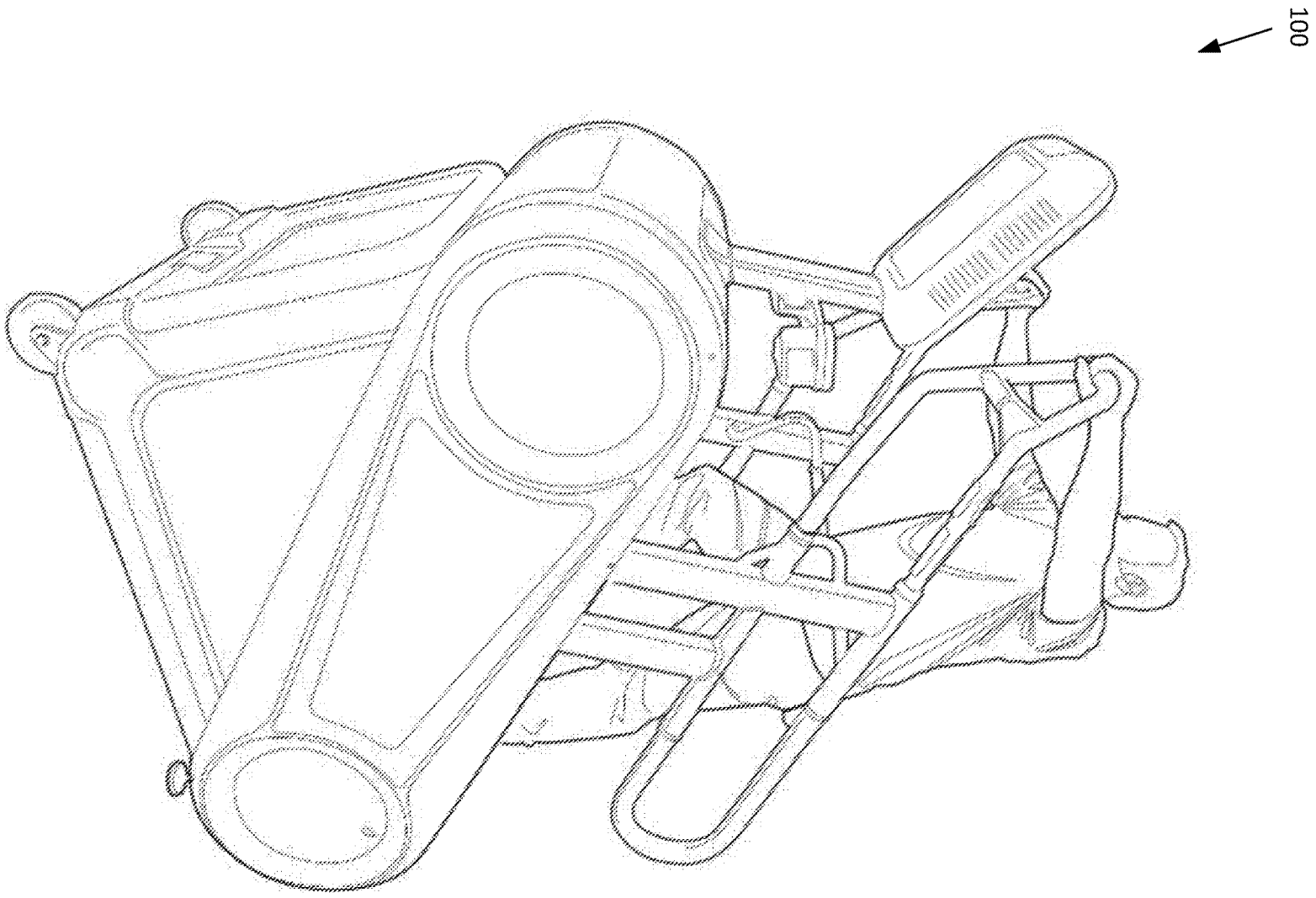
FIGS. 5-7 are perspective view diagrams illustrating other embodiments of user-exercise positions in accordance with examples of the present disclosure.
Figure 6:
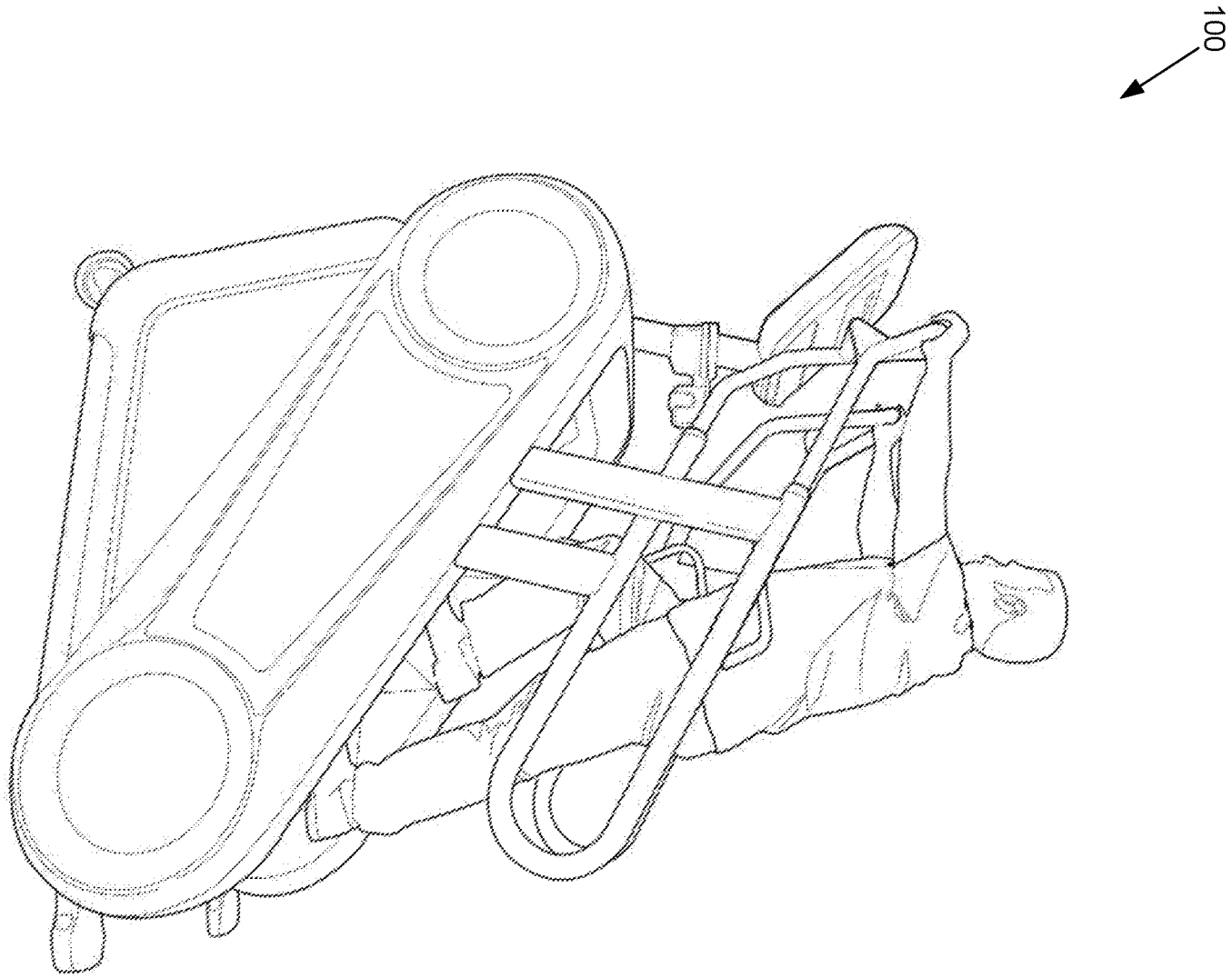
Figure 7:
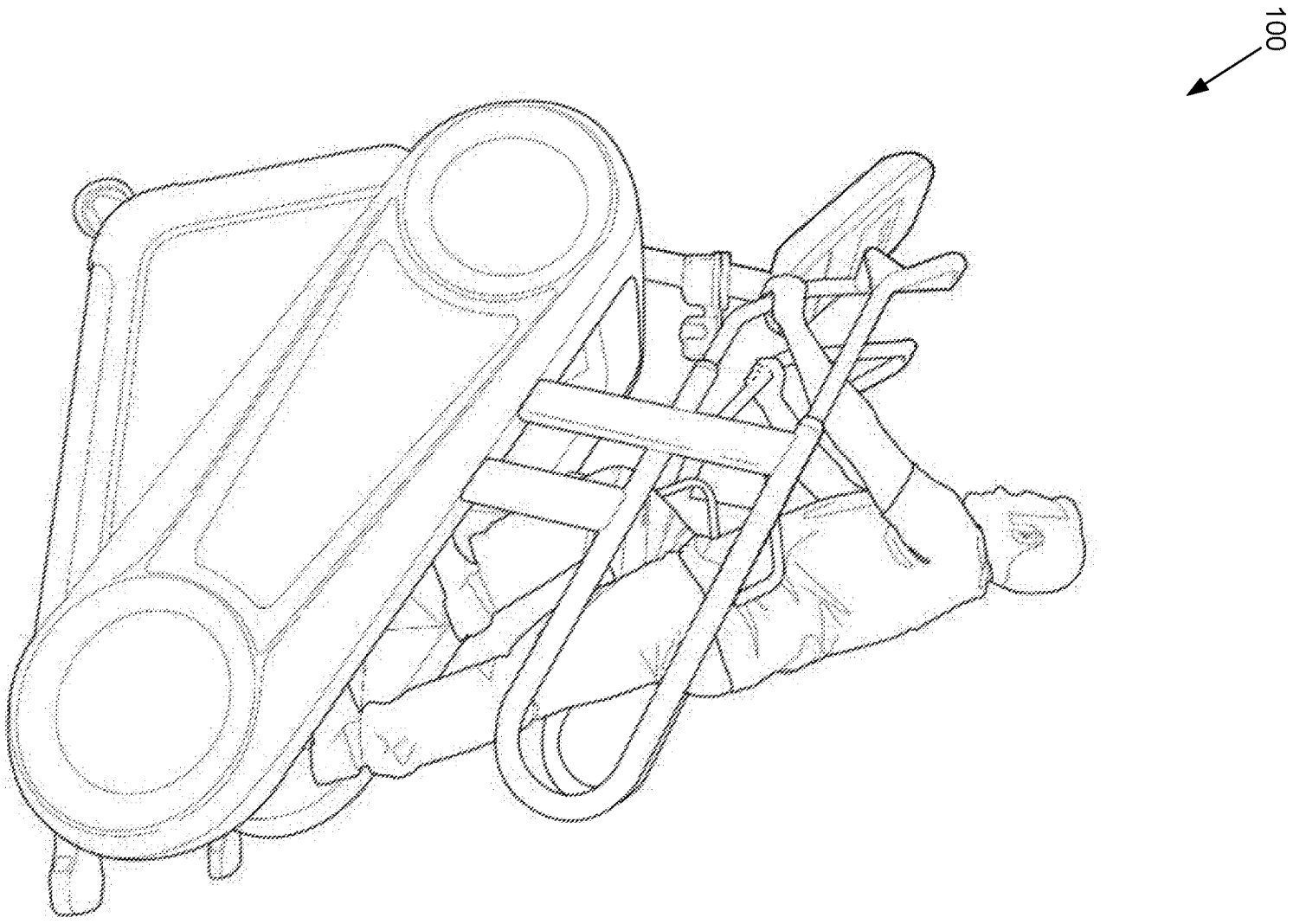

FIGS. 5-7 are perspective view diagrams illustrating other embodiments of user-exercise positions in accordance with embodiments of the present disclosure. The user may position his or her hands in a manner to allow the user to perform a combination step/sled-push exercise. The speed management capability of the machine 100 allows the user to push as hard as he or she wants without the steps gaining too much speed.

Figure 8:
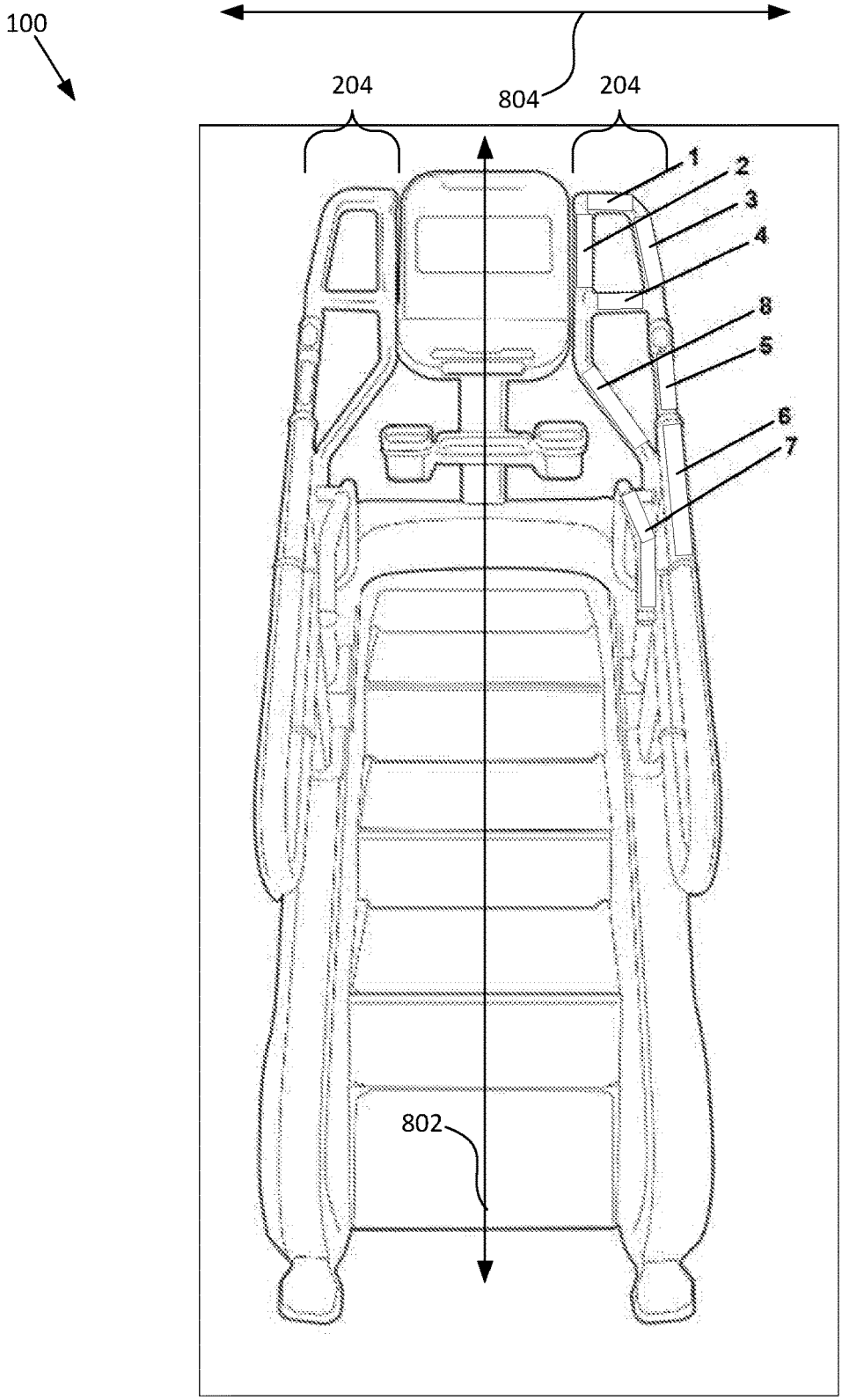
FIG. 8 is an end view diagram illustrating another embodiment of the machine in accordance with examples of the present disclosure.

FIG. 8 is an end view diagram illustrating another embodiment of the machine 100 in accordance with embodiments of the present disclosure. This particular view illustrates different handhold positions possible with the rail system 110 of the machine 100. Eight or more different handhold positions are possible. Reference number 7 identifies the farmer-carry handle. Positions 1, 2, 3, 4, and 8 identify different handhold positions that may be used during a sled-push exercise. The remaining handhold positions allow the user to use the machine 100 in a traditional step exercise manner.

As depicted, the left and right-side portions 204 include handhold positions that are oriented in different directions. Some, such as handhold positions 1 and 4 are oriented in a transverse direction 804 (i.e., side-to-side in a direction generally perpendicular to a longitudinal axis 802 that bisects the machine 100 from front to back). Others, such as 2, 3, 5, 6, and 7 are oriented in a generally longitudinal direction along the longitudinal axis 802. Other, such as handhold position 8 are oriented at an angle from the longitudinal axis 802.

Figure 9A:
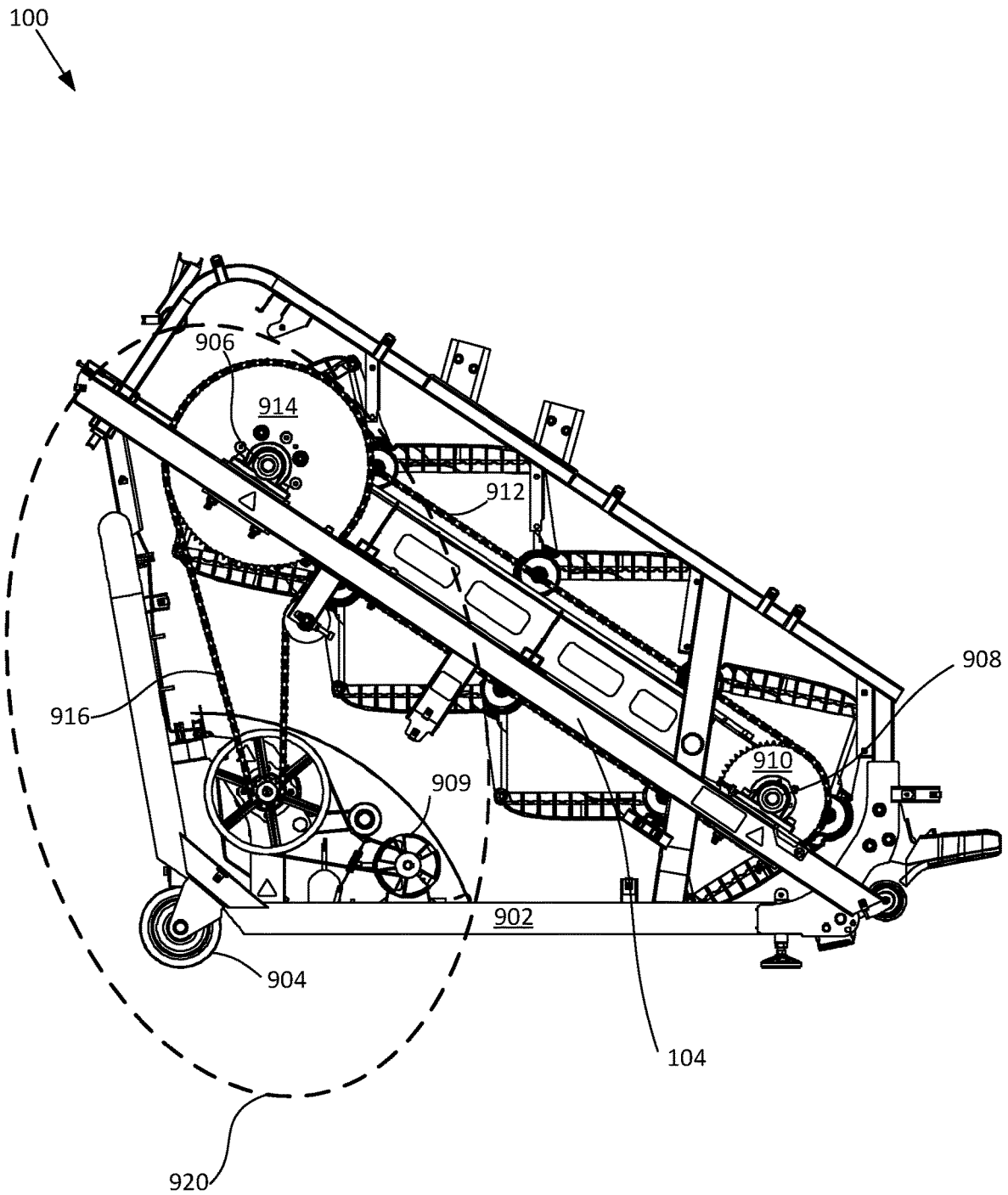
FIG. 9*a* is a side view diagram illustrating the internal components of the machine in accordance with examples of the present disclosure.

FIG. 9*a* is a side view diagram illustrating the internal components of the machine 100 in accordance with embodiments of the present disclosure. As discussed above, the machine 100 includes a frame 104 having a base 902 for engaging the floor. The base 902 may include a plurality of casters 904 for aiding in moving the machine 100 when not in use. Coupled to the frame 104 is an upper axle 906 and a lower axle 908. Both the upper axle 906 and the lower axle 908 are rotatably coupled to the frame 104. Sprockets 910 coupled to the upper and lower axles 906, 908 engage a pair of continuous chains 912.

The steps 102 are coupled to the chains 912 and drive the chains 912 around as the steps move. Also coupled to the upper axle 906 is a torque overdrive sprocket 914 that is coupled to a torque overdrive chain 916. The torque overdrive chain 916 rotationally couples the upper axle, via the torque overdrive sprocket 914 with an electric brake mechanism 909 that operates in generative mode. Examples of electric brake mechanisms 909 suitable for use with the present disclosure include, but are not limited to, AC or DC motors (brushed or brushless), alternators, and eddy coil brakes, etc.

In certain embodiments an intermediate drive system may couple the torque overdrive chain to the electric brake mechanism 909. For example, the intermediate drive system may include a sprocket coupled to a pully that drives a belt. The belt may turn a pulley coupled to the electric motor. Chain tensioners and belt tensioners may be provided.

Figure 9B:
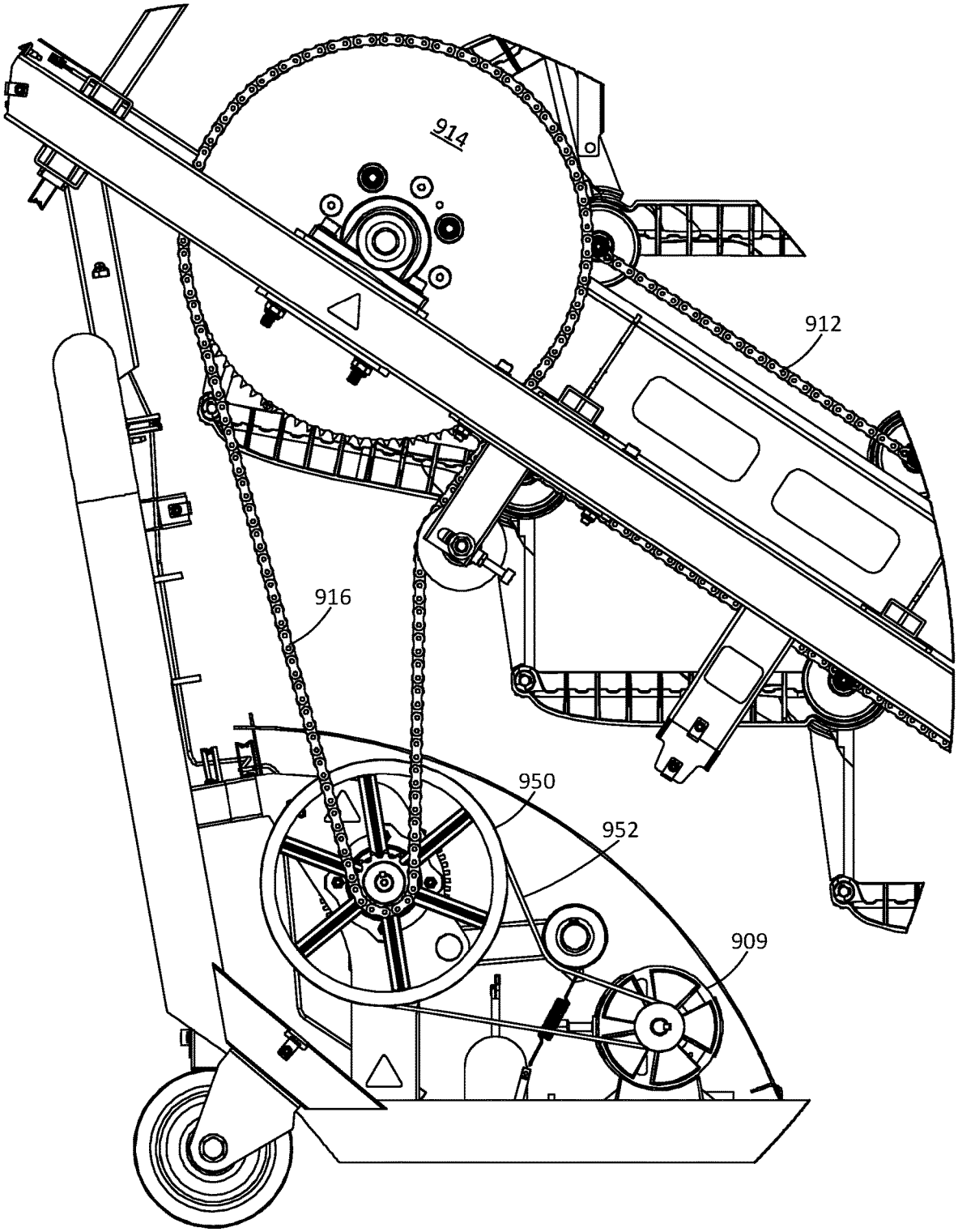
FIG. 9*b* is a side view diagram illustrating another embodiment of the internal components of the machine in accordance with examples of the present disclosure.

Included with FIG. 9*a* is a callout 920 that is depicted in greater detail with reference to FIG. 9*b*. The electric brake mechanism 909 operates in generative mode, or stated differently, takes a mechanical input (i.e., the rotation of the chain 912) and converts the mechanical energy into electrical energy. The electrical energy may be bled off through one or more resistors. In one embodiment, the electric brake mechanism 909 is a 2 HP motor.

Although the torque overdrive chain 916 is depicted as a chain, it is contemplated that other endless power transfer devices may be used, such as a belt, for example. The torque overdrive chain 916 rotationally couples the torque overdrive sprocket 914 with an intermediate pulley 950 which is rotationally coupled to the electric brake mechanism 909 via a belt 952.

Figure 10:
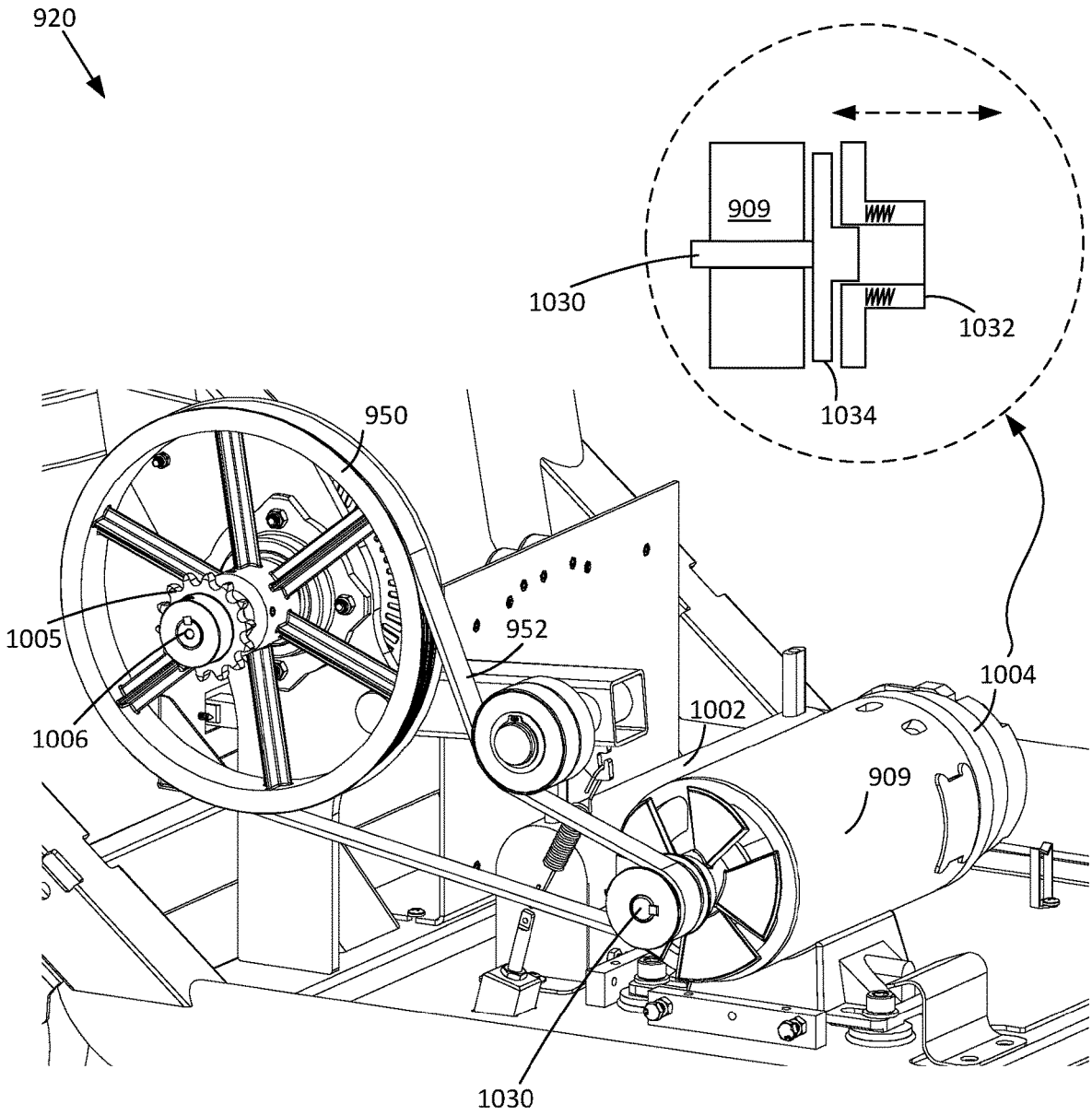
FIG. 10 is a perspective view diagram illustrating one embodiment of the generative electric motor in accordance with embodiments of the present disclosure.

FIG. 10 is a perspective view diagram illustrating one embodiment of the electric brake mechanism 909 in accordance with embodiments of the present disclosure. As described above, the electric brake mechanism 909, operating in a generative mode, is electrically coupled with one or more resistors 1002. These resistors 1002 convert the generated electricity into heat which is then dissipated. The resistors 1002 are variable and may increase or decrease the load of the electric brake mechanism 909.

Also depicted in FIG. 10 is a lower torque overdrive sprocket 1005 rotationally coupled to the intermediate pulley 950. Both the intermediate pulley 950 and the sprocket 1005 are mounted on an axle 1006 which extends through a portion of the frame and is useful for determining a speed of the stairs of the machine 100, as will be described in greater detail below with reference to FIG. 11.

Figure 11:
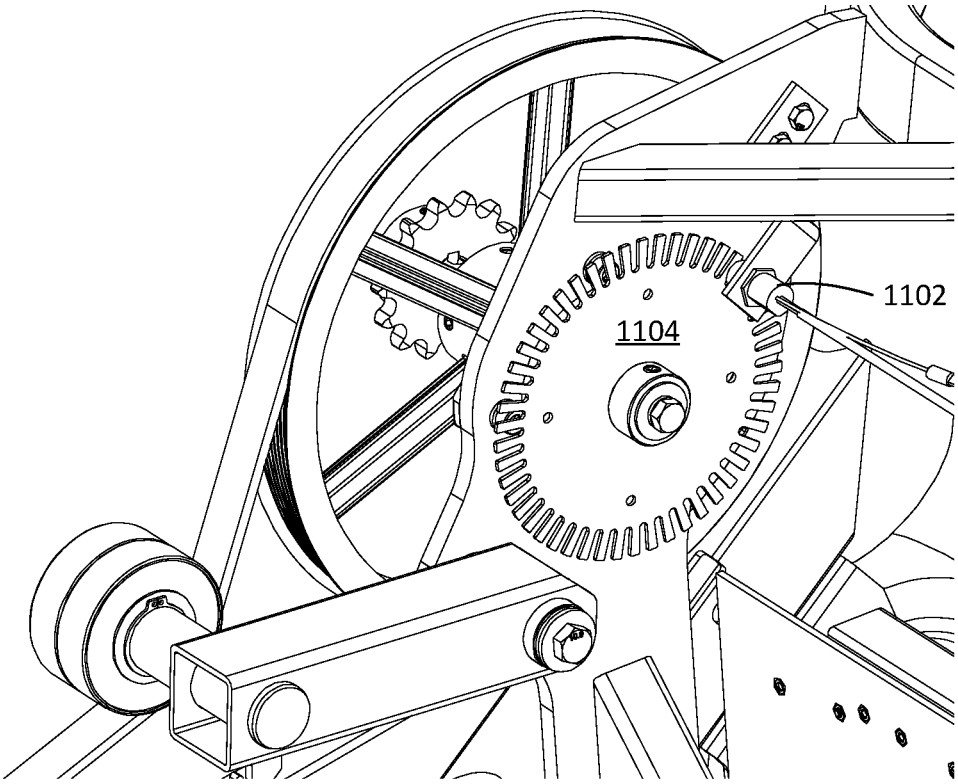
FIG. 11 is a perspective view diagram of a speed sensor for use in the machine in accordance with embodiments of the present disclosure.

FIG. 11 is a perspective view diagram of a speed sensor 1102 for use in the machine 100 in accordance with embodiments of the present disclosure. The speed sensor 1102 may be a hall sensor positioned adjacent a toothed wheel 1104. As each tooth passes by the speed sensor 1102, the speed sensor 1102 detects the presence of the tooth and communicates the presence with the controller 1401. Each tooth may be formed of a magnetic material. The controller 1401 is configured to calculate a speed based on the information received from the hall sensor. A hall effect sensor, as is known to those of skill in the art, measures the magnitude of a magnetic field. Other methods of detecting the speed may be implemented in place of a hall effect sensor, including but not limited to, optical sensors, etc. In response to the determined rotational speed, the controller 1401 is configured to command the electric motor to increase, decrease, or maintain the resistive force.

Figure 12:
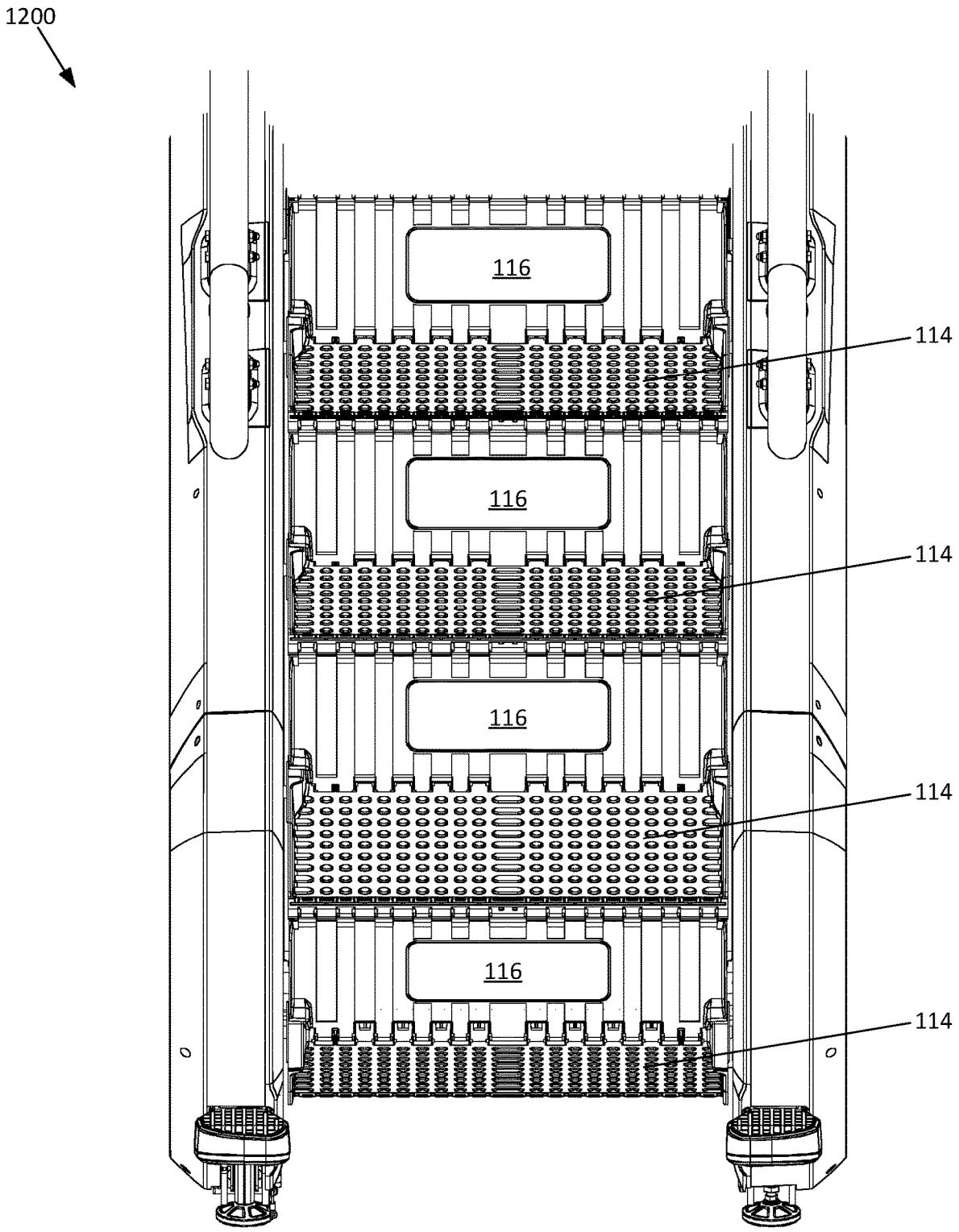
FIG. 12 is a perspective view diagram illustrating one embodiment of steps in accordance with embodiments of the present disclosure.

FIG. 12 is a perspective view diagram illustrating one embodiment of steps in accordance with embodiments of the present disclosure. The depicted embodiment illustrates the steps in a stopped position. As will be described below, the machine 100 may be configured to stop and lock into a desired position the steps in response to a user request. The stop position, as depicted, may result in a platform portion 116 stopped at an angle 1207 (see FIG. 13*b*) of between about 11 and 15 degrees with respect to the floor to aid in the ingress or egress of the user. Once a user has requested a stop, the control panel decreases the speed of the steps to a predetermined stopping speed and awaits input from a position sensor (i.e., a second hall sensor).

The position sensor detects an indicator in the toothed wheel, chain, sprocket, step, etc. and the control panel cuts power to a which then stops the system. For example, the position sensor (see position sensor 1302 of FIG. 13*b*) may be disposed on the frame 104 to detect an indicator coupled to the chain 912. The indicator may need to travel at the predetermined stopping speed for almost an entire revolution before being detected. Once the speed of the steps, during a shutdown procedure, reaches a shutdown speed, the controller 1401 may release control of the electric brake mechanism 909 to a mechanical transformer. The mechanical transformer is configured to cut power to the electric brake mechanism 909 once the position sensor detects the indicator, at which point the steps are locked in place.

Figure 13A:
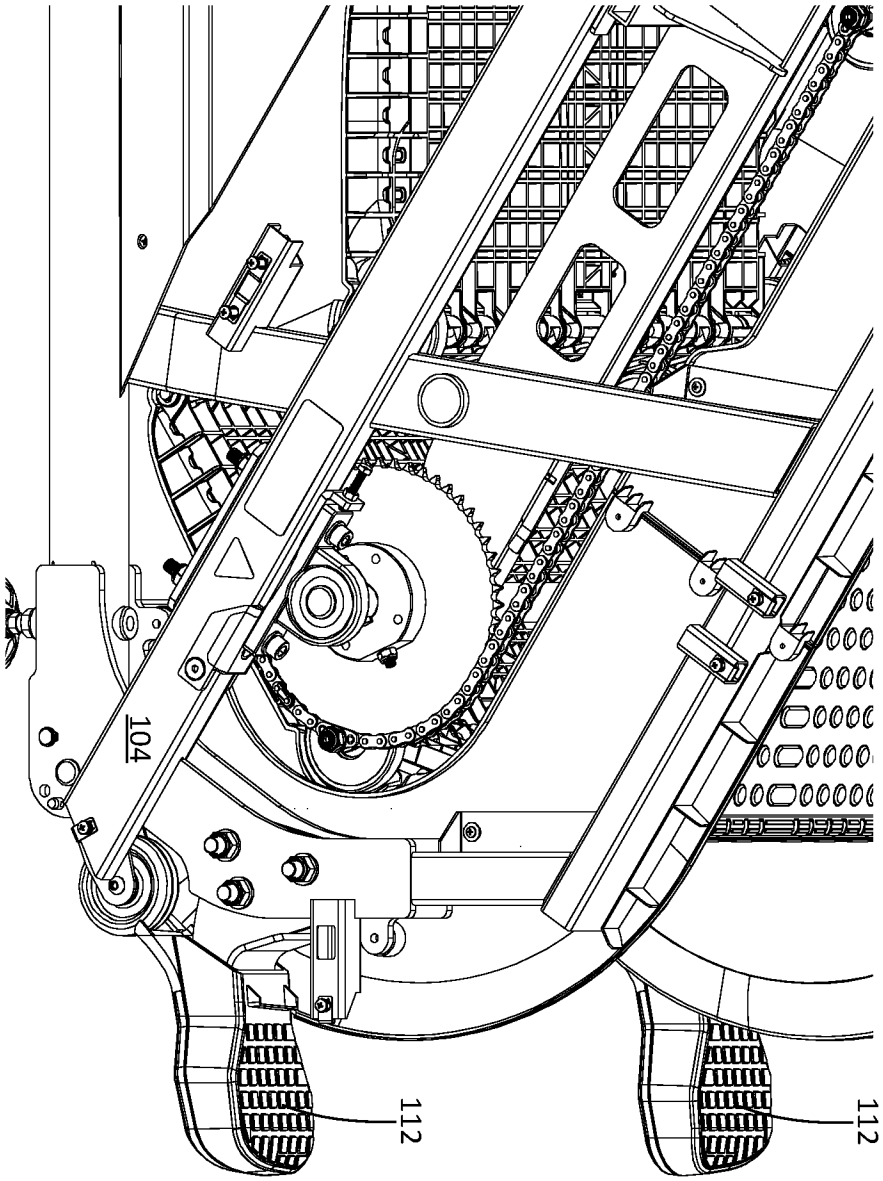
FIG. 13*a* is a perspective view diagram illustrating a zoomed in view of the frame according to examples of the subject disclosure.
Figure 13B:
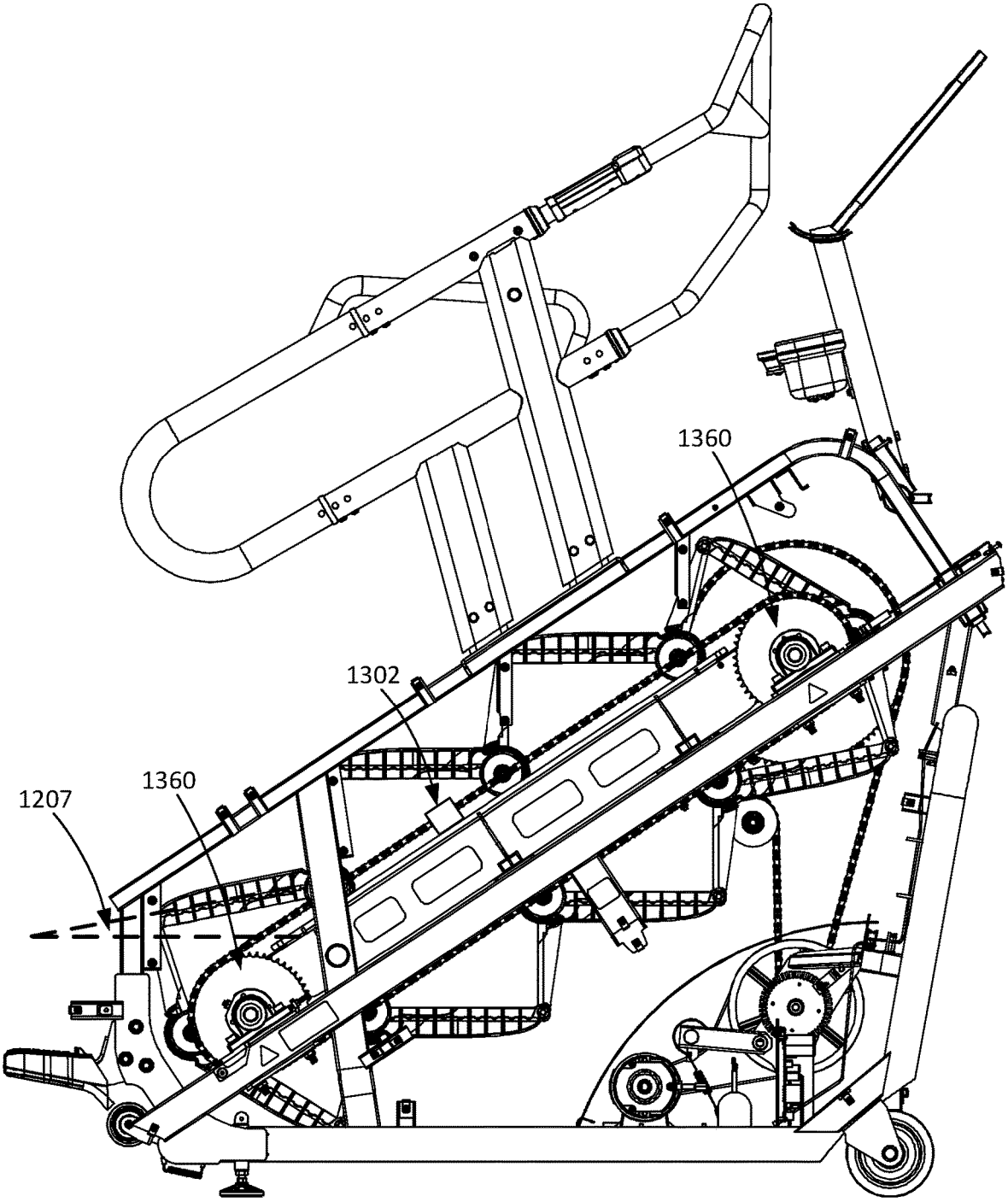
FIG. 13*b* is a side-view diagram illustrating one embodiment of the machine according to examples of the subject disclosure.

Also depicted in FIG. 13*b* is a step gear 1360 rotatably coupled to the frame 104. The step chains (the chains coupled to the plurality of steps) are configured to rotate around pairs of step gears 1360. In certain embodiments, the machine 100 includes four step gears 1360. For example, each of the upper axle and the lower axle may have a pair of step gears 1360 disposed on each side of the steps.

The braking solenoid 1004, in certain examples, is by default locked (e.g., a "power-off brake"). In other words, when the braking solenoid 1004 is not energized (i.e., "de-energized"), the braking solenoid 1004 is in a power-off mode that prevents step movement by preventing rotational movement of the output shaft of the electric brake mechanism 909. When energized, the braking solenoid 1004 releases the electric brake mechanism 909 which allows the steps to move. FIG. 10 depicts a callout bubble of the braking solenoid 1004 which shows a schematic block cross-section diagram of a braking solenoid 1004 according to examples of the subject disclosure. The braking solenoid 1004 includes a moveable armature 1032 that moves toward or away from the electric brake mechanism 909 in response to the application of electricity. When no electricity is applied, the armature 1032, which is urged by a series of springs towards the electric brake mechanism 909, prevents the output shaft 1030 from moving. A friction plate 1034, which is coupled to an end of an output shaft 1030, is engaged by the armature 1032 and prevented from spinning. This resistance is transferred through the output shaft 1030 to the intermediate drive assembly (e.g., pulley 950, belt 952, etc.) to the torque overdrive sprocket 914 and subsequently the steps. Applying electricity to the armature 1032 causes the armature 1032 to overcome the spring force, open an air gap, and allow the friction plate 1034 and the output shaft 1030 to rotate. The braking solenoid 1004 is variable, and controllable to apply a variable amount of rotational resistance to the friction plate 1034 based on an applied voltage. In other embodiments, the controller 1401 commands the electric brake mechanism 909 to increase or decrease the rotational resistance by increasing or decreasing the load of the electric brake mechanism 909 by, for example, controlling variable resistors.

FIG. 13*a* is a perspective view diagram illustrating a zoomed in view of the frame 104 according to examples of the subject disclosure. In particular, the depicted embodiment shows the access steps 112 coupled to the frame 104. The access steps 112 may be positioned on each side of the steps (see also FIG. 1). In certain examples, the access steps 112 extend rearwardly from the frame 104. Stated differently, the access steps 112 extend from the frame 104 in a direction opposite the direction a user would travel to use the machine 100.

Figure 14:
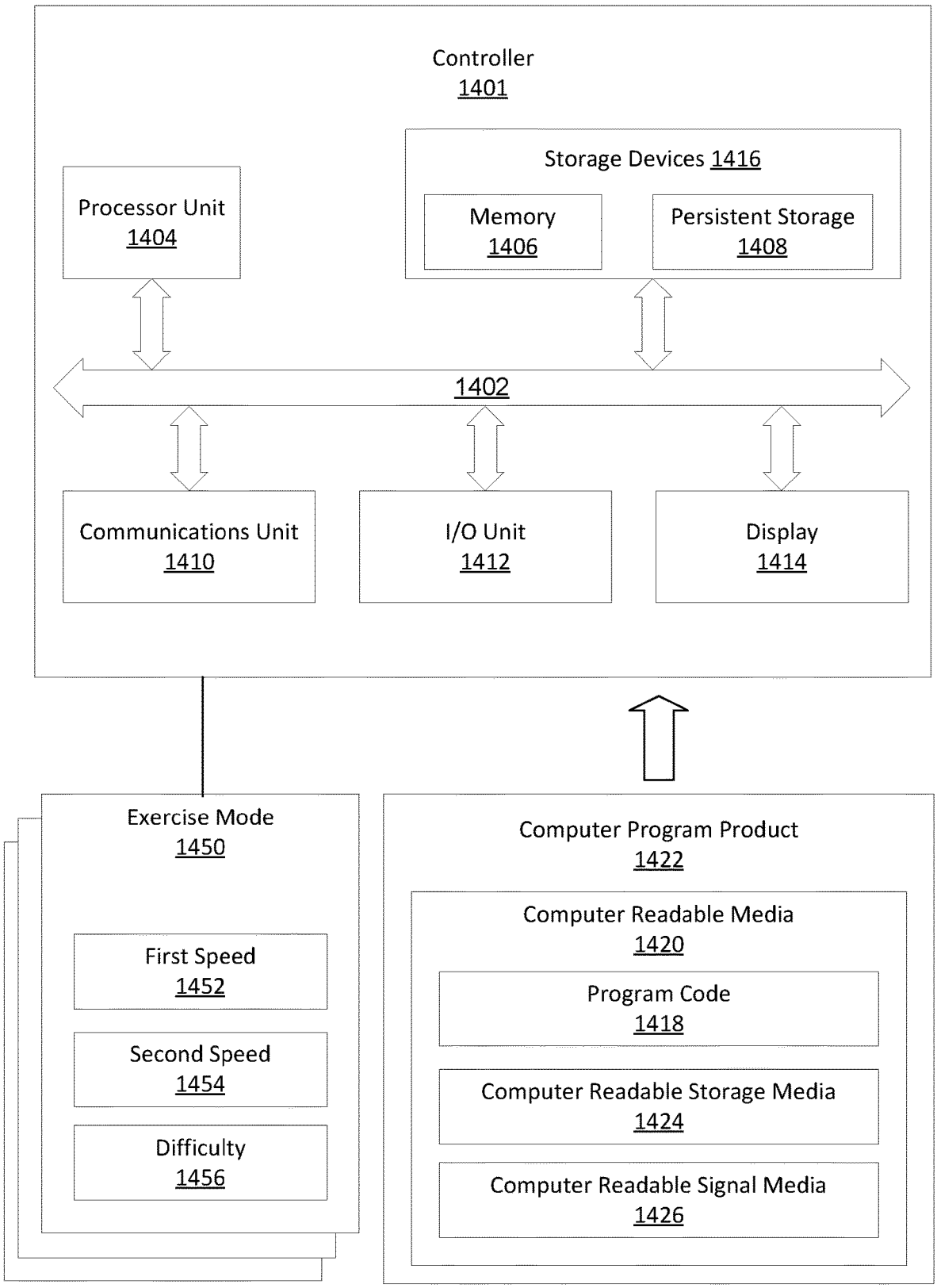
FIG. 14 is a schematic block diagram illustrating one embodiment of a controller operating on the control panel 208 in accordance with embodiments of the present disclosure.

FIG. 14 is a schematic block diagram illustrating one embodiment of a controller 1401 operating on the control panel 208 in accordance with embodiments of the present disclosure. The controller 1401 is an example of a computing device, which may be used to implement one or more components of embodiments of the invention, and in which computer usable program code or instructions implementing the processes may be located for the illustrative embodiments. In this illustrative example, the information handling system includes communications fabric 1402, which provides communications between a processor unit 1404, local memory 1406, persistent storage 1408, communications unit 1410, input/output (I/O) unit 1412, and display 1414.

The processor unit 1404 serves to execute instructions for software that may be loaded into memory 1406. The processor unit 1404 may be a set of one or more processors or may be a multi-processor core, depending on the particular implementation. Further, the processor unit 1404 may be implemented using one or more heterogeneous processor systems, in which a main processor is present with secondary processors on a single chip. As another illustrative example, the processor unit 1404 may be a symmetric multi-processor system containing multiple processors of the same type.

Memory 1406 and persistent storage 1408 are examples of storage devices 1416. A storage device is any piece of hardware that is capable of storing information, such as, for example, without limitation, data, program code in functional form, and/or other suitable information either on a temporary basis and/or a permanent basis. Memory 1406, in these examples, may be, for example, a random-access memory, or any other suitable volatile or non-volatile storage device. Persistent storage 1408 may take various forms, depending on the particular implementation. For example, persistent storage 1408 may contain one or more components or devices. For example, persistent storage 1408 may be a hard drive, a flash memory, a rewritable optical disk, a rewritable magnetic tape, or some combination of the above. The media used by persistent storage 1408 may be removable. For example, a removable hard drive may be used for persistent storage 1408.

The communications unit 1410, in these examples, provides for communication with other data processing systems or devices. In these examples, the communications unit 1410 is a network interface card. The communications unit 1410 may provide communications through the use of either, or both, physical and wireless communications links.

The input/output unit 1412 allows for the input and output of data with other devices that may be connected to data processing system. For example, the input/output unit 1412 may provide a connection for user input through a keyboard, a mouse, and/or some other suitable input device. Further, the input/output unit 1412 may send output to a printer. In other embodiments, the input/output unit 1412 communicates with the speed and position sensors to determine a rotational speed of the steps, and a position of the steps. The display 1414 provides a mechanism to display information to a user.

Instructions for the operating system, applications, and/or programs may be located in the storage devices 1416, which are in communication with the processor unit 1404 through the communications fabric 1402. In these illustrative examples, the instructions are in a functional form on persistent storage 1408. These instructions may be loaded into memory 1406 for execution by the processor unit 1404. The processes of the different embodiments may be performed by the processor unit 1404 using computer implemented instructions, which may be located in a memory, such as the memory 1406.

These instructions are referred to as program code, computer usable program code, or computer readable program code that may be read and executed by a processor in the processor unit 1404. The program code, in the different embodiments, may be embodied on different physical or computer readable storage media, such as the memory 1406 or the persistent storage 1408.

Program code 1418 is located in a functional form on computer readable media 1420 that is selectively removable and may be loaded onto or transferred to the controller 1401 for execution by the processor unit 1404. The program code 1418 and computer readable media 1420 form computer program product 1422. In one example, the computer readable media 1420 may be a computer readable storage media 1424 or a computer readable signal media 1426. The computer readable storage media 1424 may include, for example, an optical or magnetic disc that is inserted or placed into a drive or other device that is part of the persistent storage 1408 for transfer onto a storage device, such as a hard drive, that is part of the persistent storage 1408. The computer readable storage media 1424 also may take the form of a persistent storage, such as a hard drive, a thumb drive, or a flash memory that is connected to controller 1401. In some instances, the computer readable storage media 1424 may not be removable from the controller 1401.

Alternatively, the program code 1418 may be transferred to the controller 304 using computer readable signal media 1426. Computer readable signal media 1426 may be, for example, a propagated data signal containing program code 1418. For example, the computer readable signal media 1426 may be an electromagnetic signal, an optical signal, and/or any other suitable type of signal. These signals may be transmitted over communications links, such as wireless communication links, an optical fiber cable, a coaxial cable, a wire, and/or any other suitable type of communications link. In other words, the communications link and/or the connection may be physical or wireless in the illustrative examples. The computer readable media also may take the form of non-tangible media, such as communications links or wireless transmissions containing the program code.

In some illustrative embodiments, the program code 1418 may be downloaded over a network to the persistent storage 1408 from another device or data processing system through the computer readable signal media 1426 for use within the controller 1401. For instance, program code stored in a computer readable storage media in a server data processing system may be downloaded over a network from the server to the controller 1401. The system providing the program code 618 may be a server computer, a client computer, or some other device capable of storing and transmitting program code 618.

The different components illustrated for the controller 1401 are not meant to provide physical or architectural limitations to the manner in which different embodiments may be implemented. The different illustrative embodiments may be implemented in a controller including components in addition to and/or in place of those illustrated for the controller 1401. Other components shown in FIG. 14 can be varied from the illustrative examples shown. The different embodiments may be implemented using any hardware device or system capable of executing program code. For example, a storage device in the controller 1401 is any hardware apparatus that may store data. The memory 1406, persistent storage 1408, and the computer readable media 1420 are examples of storage devices in a tangible form.

In another example, a bus system may be used to implement communications fabric 1402 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, the memory 1406 or a cache such as found in an interface and memory controller hub that may be present in the communications fabric 1402.

Computer program code for carrying out operations for aspects of the present invention may be written in any combination of one or more programming languages, including an object-oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

In certain examples, the controller 1401 is configured with a plurality of exercise modes that are selectable by the user. The user may also create a custom exercise mode 1450 via the control panel 208. Each exercise mode includes an initial or first speed 1452, a maximum or second speed 1454, and a difficulty 1456. The controller 1401 is configured to control the electric brake mechanism 909 to control the rotational speed of the plurality of steps. The user may select a first speed 1452, a second speed 1454, and a difficulty 1456 that represents the increase in load the user must input to the plurality of steps to increase the rotational speed of the steps from the first speed 1452 to the second speed 1454. If the difficulty is low, for example, the user will be able to increase the speed of the steps from the first speed 1452 to the second speed 1454 with little effort (e.g., exerting a lifting force to the farmer handles or a pushing force to hand position that mimics a sled push exercise). If the user reaches the second speed 1454, the controller 1401 is configured to communicate with the electric brake mechanism 909 and increase the resistive force and prevent the speed from exceeding the second speed 1454.

In certain examples, the controller 1401 is configured to balance, in a learning mode, a load of the user on the steps. For example, the controller 1401 is configured to determine how much resistive force is required to maintain an initial speed of 25 steps per minute for a person of 150 lbs. Upon determining the appropriate resistive force to maintain the first speed 1452, the controller 1401 may appropriately determine the resistive force required to match the difficulty 1456 of the selected exercise mode 1450.

The additional load, applied by the user, is a force the user exerts on the rail system 110 of the machine 100. This additional force may be a lifting force on the farmer handles (which results in an extra pushing force on the steps) or a pushing force on one of the other hand positions (see FIGS. 5-7). The controller 1401 is configured to determine when the user has removed the additional force, and allow the electric brake mechanism to maintain the speed of the steps at the first speed 1452. For example, the resistive force may be reduced (to nearly zero for example) until the speed of the steps slows to the first speed at which point the resistive force may be increased to maintain the first speed 1452.

Figure 15:
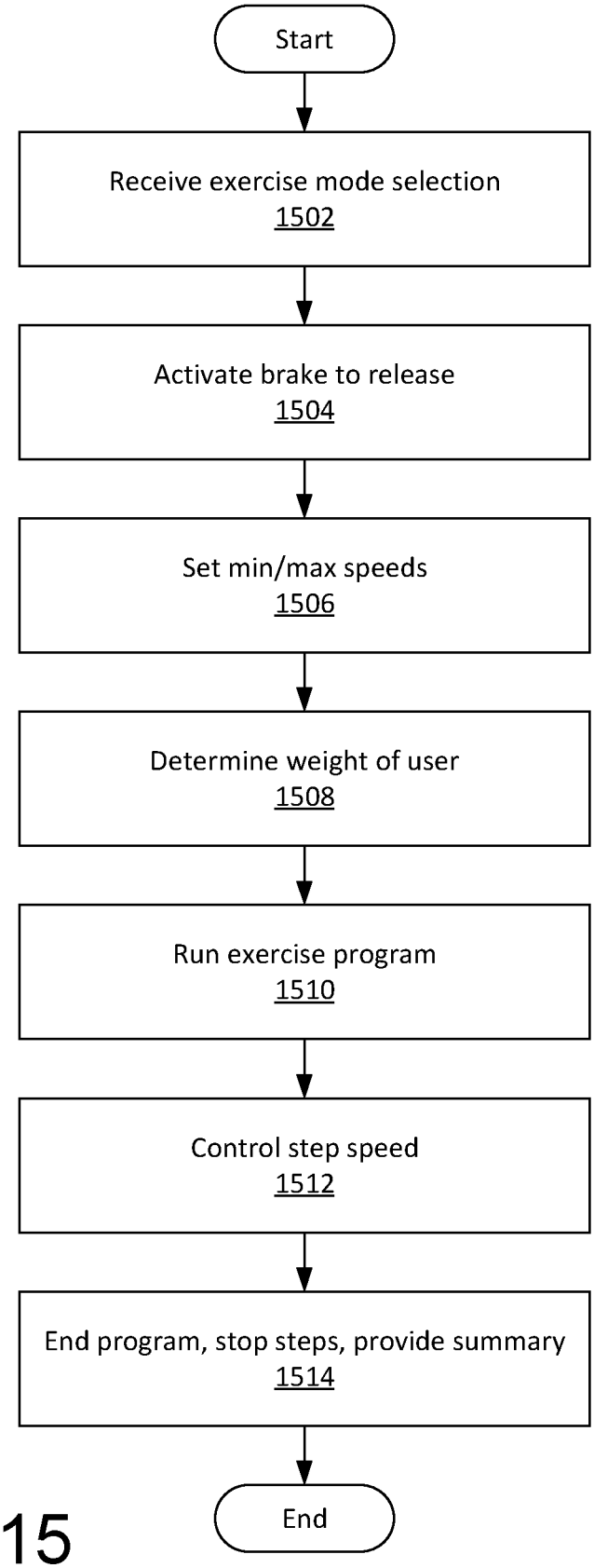
FIG. 15 is a flowchart diagram illustrating one embodiment of a method of operation of the machine in accordance with embodiments of the present disclosure.

FIG. 15 is a flowchart diagram illustrating one embodiment of a method of operation of the machine 100 in accordance with embodiments of the present disclosure. The method 1500 may be performed by processing logic that may comprise hardware (e.g., circuitry, dedicated logic, programmable logic, microcode, etc.), software (such as instructions run on a processing device), firmware, or a combination thereof. In one embodiment, the method 1500 is performed by the controller 1401.

The method 1500 starts and the processing logic, at block 1502 receives a program selection from a user. The processing logic may be configured with a multitude of different exercise program, examples of which include, but are not limited to, high intensity intervals of varying and repeated intensities, consistent intensity workouts, workouts that model a hike to a mountain top, etc. The processing logic presents the various different options to the user and receives input indicative of a selection of a workout program. The processing logic, at block 1504 activates a brake (i.e. braking solenoid 1004 of FIG. 10) to cause the brake to release the steps. In certain embodiments, the processing logic activates the brake by applying electricity to the brake.

The processing logic then, at block 1506, identifies a minimum and a maximum speed of the steps. The minimum and maximum speeds may be predefined and correspond to a specific exercise mode or workout program. In an alternative embodiment, the minimum and maximum speeds may be received as input from the user. In a further embodiment, the processing logic may be configured with a hard-maximum speed. In other words, the processing logic may be configured with an absolute maximum speed which may not be bypassed by the user. At block 1508, the processing logic determines a weight of the user. In certain embodiments, the processing logic determines the weight of the user by identifying an amount of torque needed by the electric motor to maintain a certain speed. The processing logic may maintain a table of torques and weights which may have been identified by experimentation, and thereby only require a simple lookup in the table to determine the weight of the user.

At block 1510 the processing logic executes the selected exercise program. The processing logic maintains, at block 1512, the maximum speed by providing a resistive force to the steps if the speed of the steps approaches or exceeds the selected maximum speed. Beneficially, this allows a user to exert his or herself as much as she or he wants without being able to exceed the maximum speed. The processing logic increases the load on the electric motor and thereby increases the resistive force applied to the stairs. Increasing and decreasing the load on the electric motor in turn increases and decreases the resistive force applied to the steps. Accordingly, the processing logic may limit the maximum speed of the steps. Correspondingly the processing logic may also remove the resistive force if the steps are moving too slowly. In certain examples, the processing logic controls a difficulty of the selected exercise mode. For example, a user may select an exercise mode that has a greater difficulty of going from the first speed to the second speed than another exercise mode.

At block 1514, the processing logic ends the exercise program, slows the steps to an appropriate speed (i.e., "shutdown speed") before shutting down. In response to the processing logic shutting down, the speed or location sensor communicates with a transformer and at an appropriate time the transformer cuts power to the brake which then stops and locks the steps as described above. The processing logic provides an exercise summary to the user, and the method ends.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A stair climber comprising:

a frame having a base;

an upper axle and a lower axle, each rotatably coupled to the frame;

a plurality of steps, that is endless, revolvably coupled to the upper axle and the lower axle and configured to move cyclically;

an electric brake mechanism operating in generative mode mechanically coupled with the plurality of steps and configured to provide a resistive force that is variable; and a controller operably coupled to the electric brake mechanism and configured to:

receive an indication of a selected exercise mode from a user, the selected exercise mode comprising a first speed of the plurality of steps, a second speed of the plurality of steps, and a difficulty level;

balance a load, in a learning mode, on the plurality of steps based on a user's weight at the first speed; and control, in response to the user applying an additional load to the plurality of steps via a rail system extending upward from the frame, the electric brake mechanism to apply the difficulty level of the selected exercise mode and prevent the plurality of steps from exceeding the second speed.

2. The stair climber of claim 1, further comprising a braking solenoid coupled to the electric brake mechanism and configured to prevent rotational movement of an output shaft of the electric brake mechanism when in a power-off mode.

3. The stair climber of claim 2, where the electric brake mechanism is configured to apply a variable amount of rotational resistance to the output shaft of the electric brake mechanism, and where the variable amount of rotational resistance is based on a load electrically coupled to the electric brake mechanism.

4. The stair climber of claim 3, where the controller is further configured to, in response to a determination that the user has ended the selected exercise mode, increase the resistive force to reach a shutdown speed of the plurality of steps.

5. The stair climber of claim 4, where the controller is further configured to, subsequent to the plurality of steps reaching the shutdown speed, de-energize the braking solenoid and prevent movement of the plurality of steps by stopping rotational movement of the output shaft of the electric brake mechanism.

6. The stair climber of claim 3, where the controller is further configured to, in response to a determination that the user has started the selected exercise mode, energize the braking solenoid coupled with the output shaft of the electric brake mechanism to allow rotational movement of the output shaft.

7. The stair climber of claim 3, where the load comprises a variable resistor electrically coupled to the electric brake mechanism and configured to dissipate electricity generated by the electric brake mechanism.

8. The stair climber of claim 1, further comprising a speed sensor configured to determine a rotational speed of the plurality of steps.

9. The stair climber of claim 8, where the controller is configured to communicate with the speed sensor.

10. The stair climber of claim 1, where the controller is further configured to, in response to the user removing the additional load, control the electric brake mechanism to maintain the first speed of the plurality of steps.

11. The stair climber of claim 1, further comprising a pair of chains revolvably disposed around the upper axle and the lower axle, where each of the pair of chains is coupled to the plurality of steps and engages a step gear.

12. The stair climber of claim 1, where the controller is further configured to balance the load by determining the weight of the user based on an amount of resistive force required to maintain the first speed of the plurality of steps.

13. A controller comprising:

at least one processor; and a memory storing code, the code being executable by the at least one processor and cause the processor to;

receive, at the controller operably coupled to a stair climber device having a frame, an electric brake mechanism, and a plurality of steps that is endless, an indication of a selected exercise mode from a user, the selected exercise mode comprising a first speed of the plurality of steps, a second speed of the plurality of steps, and a difficulty level;

balance a load, in a learning mode, on the plurality of steps based on a user's weight at the first speed; and control, in response to the user applying an additional load to the plurality of steps via a rail system extending upward from the frame, the electric brake mechanism to apply the difficulty level of the selected exercise mode and prevent the plurality of steps from exceeding the second speed.

14. The controller of claim 13, where the processor is further caused to control a braking solenoid coupled to the electric brake mechanism to prevent rotational movement of an output shaft of the electric brake mechanism when in a power-off mode.

15. The controller of claim 14, where the processor is further caused to, in response to a determination that the user has started the selected exercise mode, energize the braking solenoid coupled with the output shaft of the electric brake mechanism to allow rotational movement of the output shaft.

16. The controller of claim 13, where the processor is further caused to control, in response to the user removing the additional load, the electric brake mechanism to maintain the first speed of the plurality of steps.

17. A method of controlling a speed of a plurality of steps of an exercise machine, the method comprising:

receiving, at a controller operably coupled to the exercise machine which has a frame, an electric brake mechanism, and a plurality of steps that is endless, an indication of a selected exercise mode from a user, the selected exercise mode comprising a first speed of the plurality of steps, a second speed of the plurality of steps, and a difficulty level;

balancing a load, in a learning mode, on the plurality of steps based on a user's weight at the first speed; and controlling, in response to the user applying an additional load to the plurality of steps via a rail system extending upward from the frame, the electric brake mechanism to apply the difficulty level of the selected exercise mode and prevent the plurality of steps from exceeding the second speed.

18. The method of claim 17, further comprising controlling, in response to the user removing the additional load, the electric brake mechanism to maintain the first speed of the plurality of steps.

19. The method of claim 17, further comprising controlling a braking solenoid coupled to the electric brake mechanism to prevent rotational movement of an output shaft of the electric brake mechanism when in a power-off mode.

* * * * *